US010233727B2

(12) United States Patent
Conn et al.

(10) Patent No.: US 10,233,727 B2
(45) Date of Patent: Mar. 19, 2019

(54) INDUCED CONTROL EXCITATION FOR ENHANCED RESERVOIR FLOW CHARACTERIZATION

(71) Applicants: INTERNATIONAL BUSINESS MACHINES CORPORATION, Armonk, NY (US); SHELL OIL COMPANY, Houston, TX (US)

(72) Inventors: Andrew R. Conn, Mount Vernon, NY (US); Lior Horesh, Ossining, NY (US); Eduardo Antonio Jimenez Arismendi, Katy, TX (US); Ulisses Mello, Blauvelt, NY (US); Gijs Van Essen, The Hague (NL)

(73) Assignees: International Business Machines Corporation, Armonk, NY (US); SHELL OIL COMPANY, Houston, TX (US)

( * ) Notice: Subject to any disclaimer, the term of this patent is extended or adjusted under 35 U.S.C. 154(b) by 732 days.

(21) Appl. No.: 14/447,165

(22) Filed: Jul. 30, 2014

(65) Prior Publication Data

US 2016/0032692 A1 Feb. 4, 2016

(51) Int. Cl.

| | |
|---|---|
| ***E21B 41/00*** | (2006.01) |
| ***E21B 43/16*** | (2006.01) |
| *E21B 43/24* | (2006.01) |
| *E21B 43/30* | (2006.01) |

(52) U.S. Cl.

CPC ..... *E21B 41/0092* (2013.01); *E21B 43/16* (2013.01); *E21B 43/24* (2013.01); *E21B 43/30* (2013.01)

(58) Field of Classification Search
None
See application file for complete search history.

(56) References Cited

U.S. PATENT DOCUMENTS 3,410,344 A * 11/1968 Cornelius ..... E21B 21/14 166/303
3,480,081 A * 11/1969 Felsenthal ..... E21B 43/16 166/266
3,493,049 A * 2/1970 Matthews ..... E21B 43/16 166/271

(Continued)

OTHER PUBLICATIONS

Van Doren, et al., "Parameter identification in large-scale models for oil and gas production," 18th IFAC World Congress, Milano Italy, Aug. 28-Sep. 2, 2011, pp. 10857-10862.

(Continued)

*Primary Examiner* — Mohammad Ali
*Assistant Examiner* — Kelvin Booker
(74) *Attorney, Agent, or Firm* — Scully, Scott, Murphy & Presser, P.C.; Daniel Morris, Esq.

(57) ABSTRACT

A system, method and a computer program product may be provided for characterizing natural resource subsurface attributes and compositions. The system prescribes alterations of one or more controls of a natural resource. The system applies the altered controls to the natural resource wells. The system collects measurement data of the natural resource wells that responds to the applied altered controls. The system determines, based on the collected measurement data, the natural resource subsurface attributes and compositions that pertain to the natural resource.

22 Claims, 10 Drawing Sheets

(56) References Cited

U.S. PATENT DOCUMENTS 3,605,888 A * 9/1971 Crowson et al. ..... E21B 43/16 166/248
4,456,065 A * 6/1984 Heim ..... E21B 43/16 166/248
4,458,751 A * 7/1984 Haynes ..... E21B 17/06 166/133
4,697,642 A * 10/1987 Vogel ..... E21B 43/40 166/266
5,014,787 A * 5/1991 Duerksen ..... E21B 43/24 166/303
5,131,471 A * 7/1992 Duerksen ..... E21B 43/24 166/303
5,263,822 A * 11/1993 Fujio ..... F04C 18/0215 418/55.4
5,339,905 A * 8/1994 Dowker ..... E21B 43/16 166/324
5,607,016 A * 3/1997 Butler ..... C09K 8/58 166/263
5,771,973 A * 6/1998 Jensen ..... E21B 43/16 166/303
2003/0066652 A1* 4/2003 Stegemeier ..... E21B 43/12 166/373
2003/0164240 A1* 9/2003 Vinegar ..... E21B 17/003 166/372
2004/0256099 A1* 12/2004 Nguyen ..... E21B 43/003 166/249
2007/0000663 A1* 1/2007 Kelley ..... E21B 43/121 166/268
2008/0115930 A1* 5/2008 Peters ..... E21B 43/28 166/248
2008/0128134 A1* 6/2008 Mudunuri ..... C10G 1/02 166/302
2009/0012765 A1* 1/2009 Raphael ..... E21B 43/00 703/10
2009/0071651 A1* 3/2009 Patel ..... E21B 43/10 166/297
2009/0071652 A1* 3/2009 Vinegar ..... E21B 36/04 166/303
2009/0260823 A1* 10/2009 Prince-Wright ..... C10G 21/22 166/302
2009/0277639 A1* 11/2009 Schultz ..... E21B 43/16 166/305.1
2009/0308598 A1* 12/2009 Gardes ..... E21B 43/006 166/246
2010/0059226 A1* 3/2010 Termine ..... C09K 8/66 166/308.1
2010/0096129 A1* 4/2010 Hinkel ..... E21B 43/16 166/270.1
2010/0198570 A1 8/2010 Sarma et al.
2011/0042083 A1* 2/2011 Sierra ..... E21B 43/12 166/271
2011/0209869 A1* 9/2011 Smith ..... E21B 43/16 166/260
2011/0226471 A1* 9/2011 Wattenbarger ..... C09K 8/58 166/263
2011/0250582 A1* 10/2011 Gates ..... C09K 8/582 435/3
2011/0264373 A1* 10/2011 Hehmeyer ..... E21B 43/16 702/13
2011/0290479 A1* 12/2011 Izgec ..... E21B 43/16 166/250.02
2011/0295771 A1* 12/2011 Dawson ..... E21B 43/16 705/500
2011/0308811 A1 12/2011 Ghayour et al.
2012/0160496 A1* 6/2012 Tardy ..... E21B 43/16 166/305.1
2012/0232865 A1 9/2012 Maucee et al.
2012/0234535 A1* 9/2012 Dawson ..... E21B 43/16 166/263
2012/0253770 A1* 10/2012 Stern ..... G01V 11/00 703/10
2012/0325467 A1* 12/2012 Lebel ..... E21B 43/16 166/263
2013/0032336 A1* 2/2013 Abbate ..... E21B 43/24 166/250.01
2013/0098607 A1* 4/2013 Kerr ..... E21B 43/16 166/256
2013/0118736 A1* 5/2013 Usadi ..... G06F 17/5018 166/268
2013/0133884 A1* 5/2013 Ayasse ..... E21B 43/305 166/256
2013/0146283 A1* 6/2013 Ayasse ..... E21B 43/243 166/256
2014/0008062 A1* 1/2014 Manrique ..... C09K 8/602 166/270.1
2014/0034305 A1* 2/2014 Dawson ..... C09K 8/58 166/268
2014/0096962 A1* 4/2014 Kerr ..... E21B 43/2408 166/272.3
2014/0156238 A1* 6/2014 Rashid ..... E21B 43/00 703/2
2015/0000927 A1* 1/2015 Madell ..... E21B 34/063 166/373
2015/0161304 A1* 6/2015 Vachon ..... G01V 99/005 703/10
2015/0369023 A1* 12/2015 MacPhail ..... E21B 43/12 166/269
2016/0222284 A1* 8/2016 He ..... C09K 8/86
2016/0245049 A1* 8/2016 Mogensen ..... E21B 43/25

OTHER PUBLICATIONS

Van Den Hof, et al., "Recent developments in model-based optimization and control of subsurface flow in oil reservoirs," Proceedings of the 2012 IFAC Workshop on Automatic Control in Offshore Oil and Gas Production, Norwegian University of Science and Technology, Trondheim, Norway, May 31-Jun. 1, 2012, pp. 189-200.

Haber et al., "Numerical methods for the design of large-scale nonlinear discrete ill-posed inverse problems", Inverse Problems, vol. 26, No. 2, (2010), published Dec. 18, 2009, pp. 1-14.

Horesh et al., "Optimal Experimental Design for the Large-Scale Nonlinear III-posed Problem of Impedance Imaging", Wiley Book Series on Computational Methods for Large-Scale Inverse Problems and Quantification of Uncertainty, 2012.

Oliver et al., "Inverse Theory for Petroleum Reservoir Characterization and History Matching", 377 p., ISBN 978-0-521 -88151-7, BOOK, Cambridge University Press, copyright D.S. Oliver, A.C. Reynolds, N. Liu 2008.

Van Doren et al., "Structural Identifiability of Grid Block and Geological Parameters in Reservoir Simulation Models", ECMOR XI B15, 11th European Conference on the Mathematics of Oil Recovery—Bergen, Norway, Sep. 8-11, 2008.

Sarma et al., "Implementation of Adjoint Solution for Optimal Control of Smart Wells", SPE Paper 92864, presented at the SPE Reservoir Simulation Symposium, Houston, TX, 2005, Jan. 31, 2005-Feb. 2, 2005, pp. 1-17.

Bryson, JR, et al., "Applied Optimal Control: Optimization, Estimation, and Control", Taylor & Francis Group, LLC, New York, NY 1975. ISBN 10: 0-89116-228-3.

* cited by examiner

CONTROL MODULATED MODEL RECOVERY

MODEL USING NON-MODULATED CONTROLS FIGS. 4-5

TRUE MODEL

INDUCED CONTROL EXCITATION FOR ENHANCED RESERVOIR FLOW CHARACTERIZATION

BACKGROUND

This disclosure relates generally to characterizing natural resource subsurface attributes and composition and particularly to characterizing natural resource subsurface attributes and composition by varying of production controls (e.g. water injection rate and bottom-hole-pressure) pertaining to the natural resource injection and production wells.

BACKGROUND OF THE INVENTION

A natural resource includes, but is not limited to: oil, water, natural gas, frozen gas, liquid or solid materials located beneath the Earth's surface, e.g., in underground soil or underneath sea water, etc. A natural resource well includes, but is not limited to: an oil well, a natural gas well, etc. A natural resource well production includes, but is not limited to: oil recovery from a corresponding oil well, a natural gas recovery from a corresponding natural gas reservoir, frozen gas recovery from a corresponding frozen gas reservoir, etc.

SUMMARY

A system, method and a computer program product may be provided for characterizing natural resource subsurface attributes and compositions. The system alters one or more controls of a natural resource well(s). The system applies the altered controls to the natural resource wells. The system collects measurement data of the natural resource wells that responds to the applied altered controls. The system characterize, based on the collected measurement data, the natural resource subsurface attributes and compositions that pertain to the natural resource well.

The applied altered controls include one or more of: (1) varying the injection rate of an injected entity, e.g., water, polymers, gas, or steam, etc., into natural resource well, or (2) varying of bottom-hole-pressure or any other pressure control of the natural resource well.

BRIEF DESCRIPTION OF THE DRAWINGS

These and other objects, features and advantages of the present invention will become apparent from the following detailed description of illustrative embodiments thereof, which is to be read in connection with the accompanying drawings, in which:

FIG. 8A illustrates an example of true physical permeability distribution of a natural resource; FIG. 8B illustrates an example of natural resource permeability recovery without induced alteration of the controls; FIG. 8C illustrates an example of natural resource recovery based on data from natural resource in which controls pertaining to natural resource recovery are intentionally altered in one embodiment;

DETAILED DESCRIPTION

Figure 4:
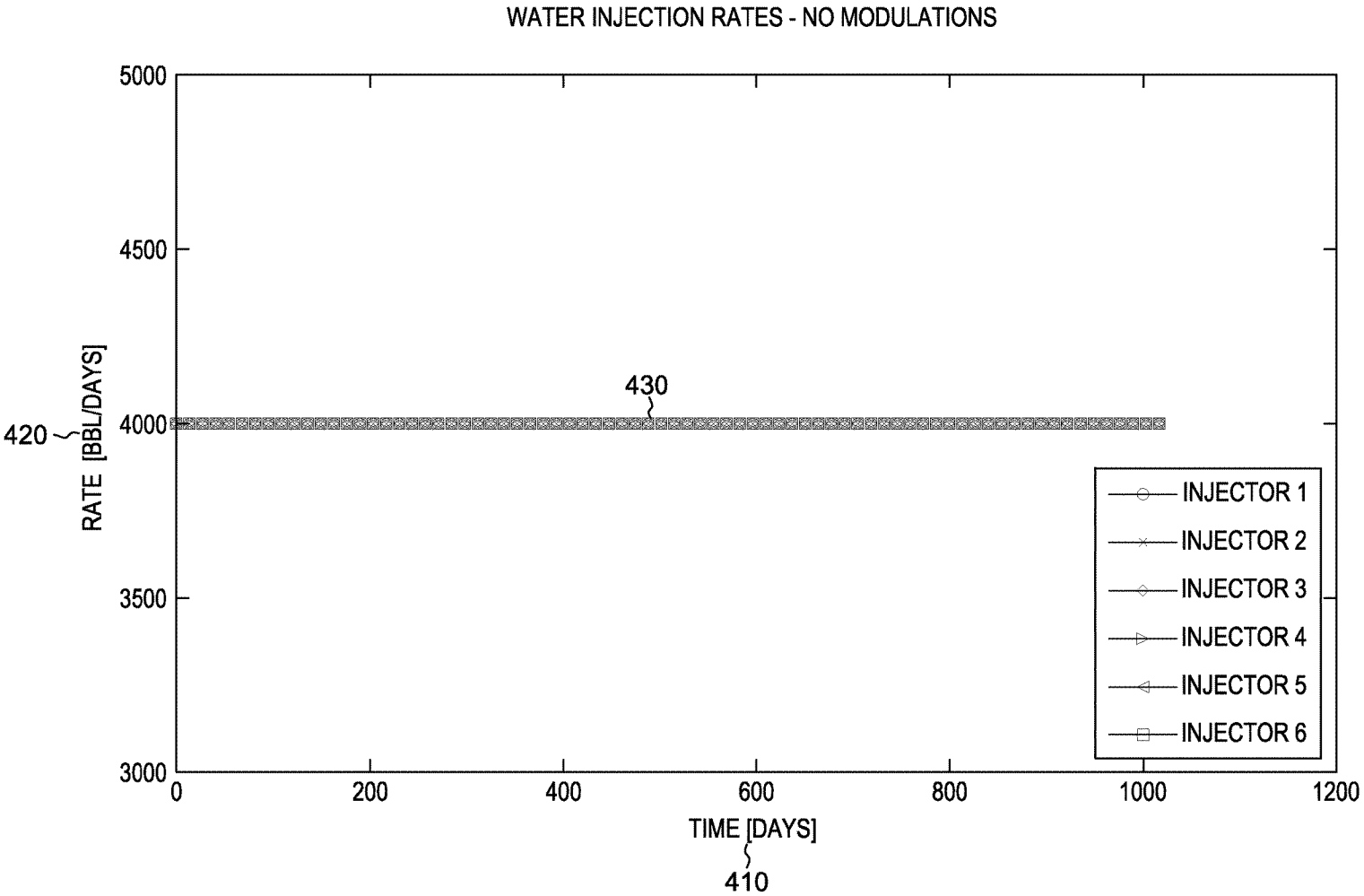
FIG. 4 illustrates an exemplary steady rate of water injected to natural resource wells in one embodiment.
Figure 10:
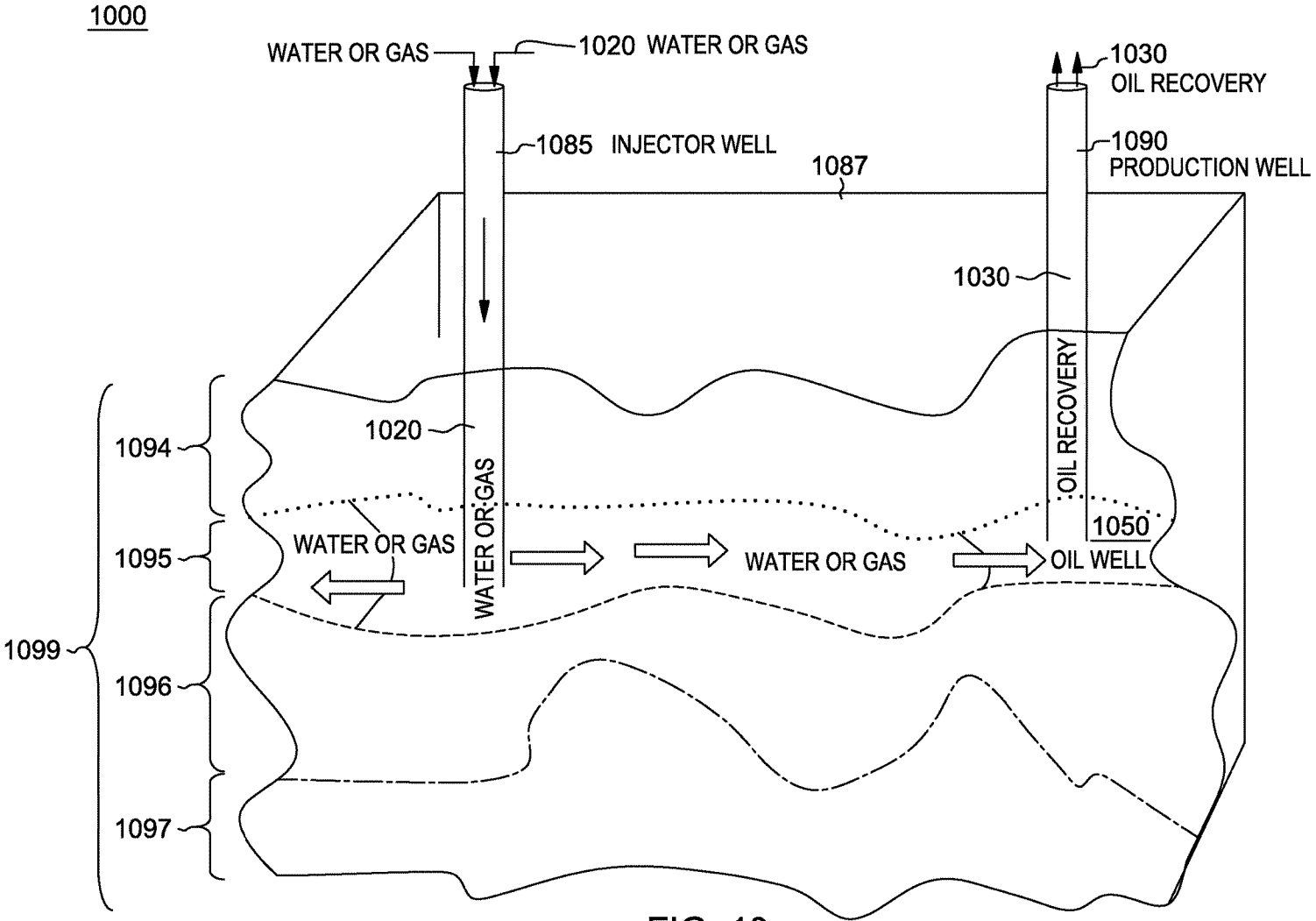
FIG. 10 illustrates an example oil well recovery 1000 according to one embodiment.

A system, method and computer program product to enable inference and prediction of flow of fluids in a natural resource reservoir in order to make rationalized business decisions or in order to sustain efficient business operations. For example, prediction of natural resource subsurface flow, e.g., oil, natural gas, frozen gas, etc., requires understanding of natural resource subsurface attributes and its composition. FIG. 10 illustrates an example oil well recovery 1000 according to one embodiment. As shown in FIG. 10, a natural resource subsurface 1099 refers to herein physical structures and conditions underneath a soil surface 1087. A natural resource subsurface 1099 may include a plurality of physical layers 1094-1097 each of which may include different material(s). Natural resource production data includes, but is not limited to: an amount of natural resources constituents that are extracted from natural resource wells, measurement data (e.g., pressures, fluid flow rates, etc.) associated with the natural resource well that may be used to infer the natural resource subsurface attributes and compositions. A computing system may collect the measurement data, e.g., by using fixed controls (for example, steady water injection rate as shown in FIG. 4) or varying controls (for example, varying water injection rate as shown in FIG. 6). A water injection rate includes, but is not limited: a rate (i.e., an exemplary water injection rate 430 shown in FIG. 4) of water being injected into a natural resource well, etc. A bottom-hole-pressure includes, but is not limited to: a pressure at the bottom (i.e., an exemplary bottom-hole-pressure 520 shown in FIG. 5) of a natural resource well.

Figure 3:
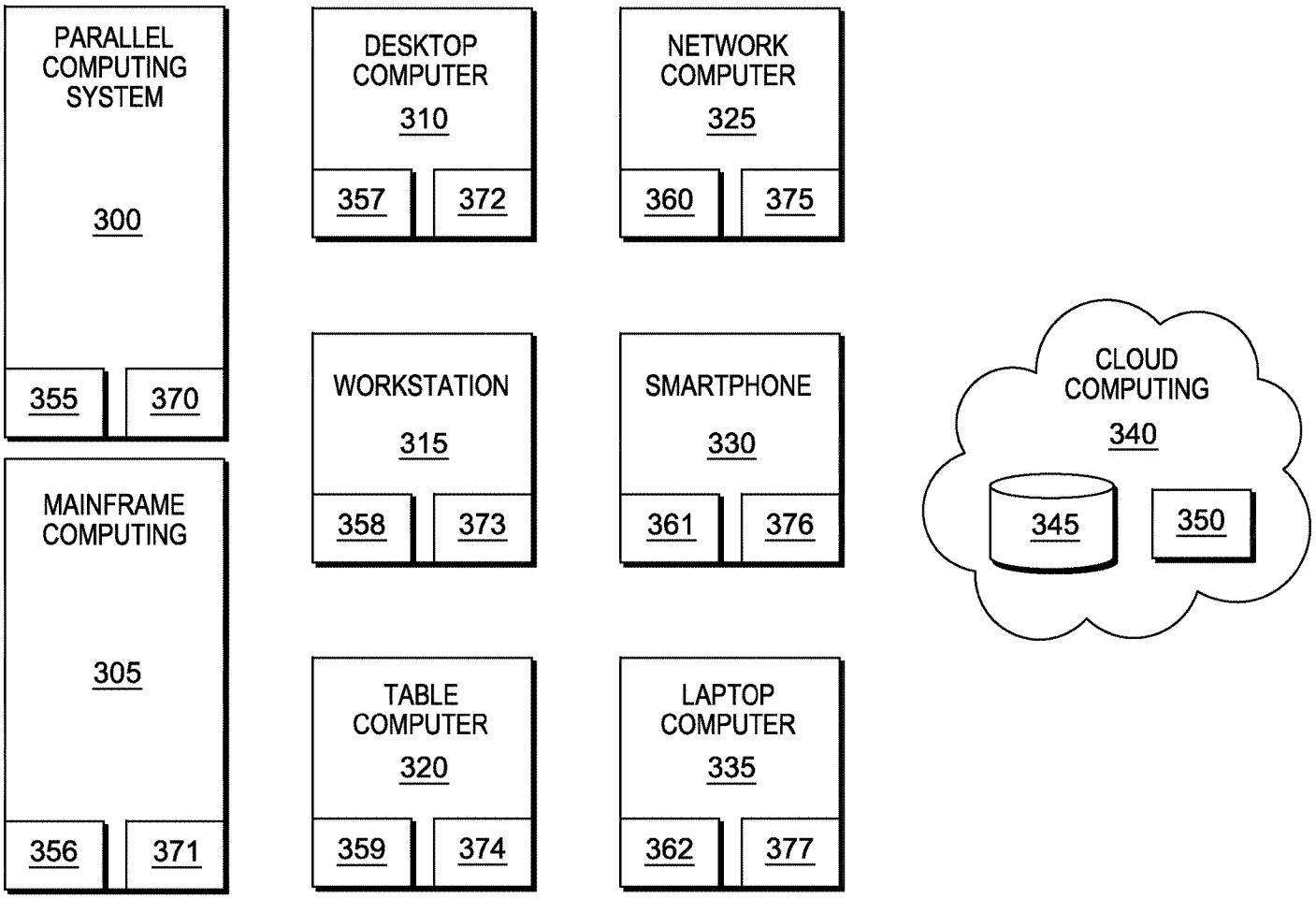
FIG. 3 illustrates an exemplary hardware configurations in one embodiment.

FIG. 3 illustrates examples of the computing system employed to infer the natural resource subsurface attributes and compositions underground reservoirs in the manner described herein. An example computing system may include, but are not limited to: a parallel computing system 300 including at least one processor 355 and at least one memory device 370, a mainframe computer 305 including at least one processor 356 and at least one memory device 371, a desktop computer 310 including at least one processor 357 and at least one memory device 372, a workstation 315 including at least one processor 358 and at least one memory device 373, a tablet computer 320 including at least one processor 359 and at least one memory device 374, a netbook computer 325 including at least one processor 360 and at least one memory device 375, a smartphone 330 including at least one processor 361 and at least one memory device 376, a laptop computer 335 including at least one processor 362 and at least one memory device 377, or a cloud computing system 340 including at least one storage device 345 and at least one server device 350.

A user may authorize the fixed or varying controls in order to serve a natural resource production objective, e.g., maximizing of a net present value (NTV) and/or minimizing a water production, etc. Perturbation (i.e., manipulation or alteration or modulation) of controls may impair immediate natural resource production goals. However, properly prescribed alterations (e.g., a varying water injection rate as shown in 6) of the controls offer greater ability to characterize the subsurface, and thereby overall long-term superior capability to meet desired natural resource production goals. The user may avoid unnecessary (beyond a prescribed) modulation of controls in order to minimize impairment of the natural resource immediate production goals.

Figure 9:
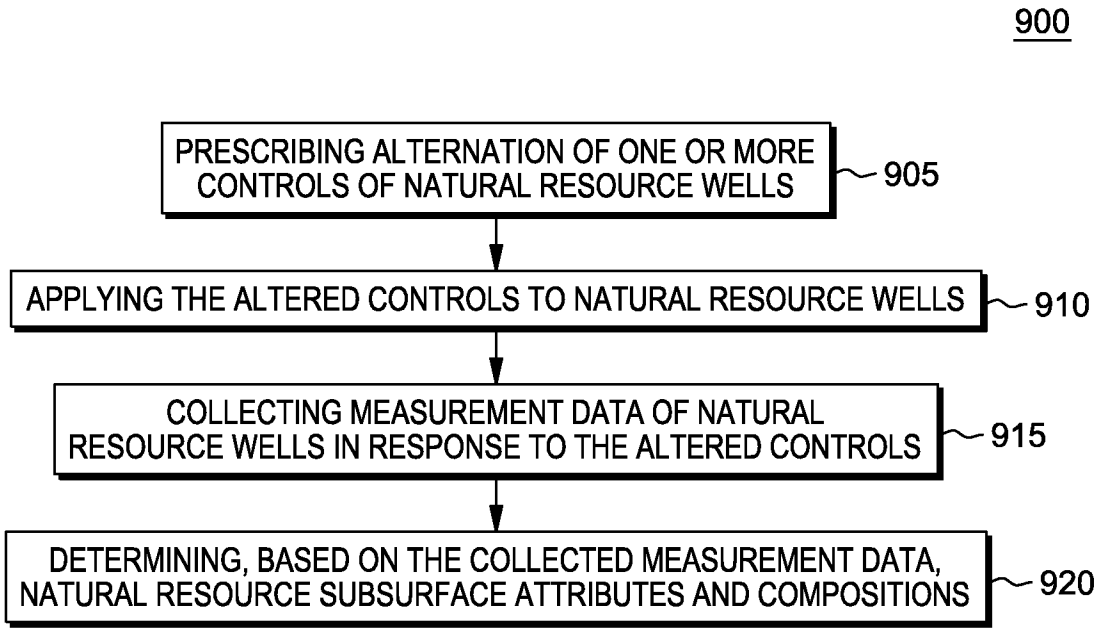
FIG. 9 illustrates an example flowchart that describes method steps for recovery of natural resource subsurface attributes and compositions according to one embodiment.

FIG. 9 illustrates a flowchart that describes method steps for discovering natural resource subsurface attributes and compositions according to one embodiment. At 905, the computing system is configured to alter one or more controls of a natural resource well. The one or more altered controls (i.e., control excitations) include, but are not limited to: (1) varying of a water injection rate of the water injectors, (2) varying of bottom-hole-pressure (BHP) of the natural resource production wells, etc. At 910, the computing system and/or the user applies the altered controls to the natural resource wells.

At 915, the computing system collects the measurement data of the natural resource well that responds to the applied altered controls. In order to collect the measurement data, the computing system may detect reactions of a corresponding natural resource subsurface, which respond to the applied altered controls. In order to detect the reaction of the natural resource subsurface, the computing system may probe, e.g., by using one or more sensors, a medium associated with the natural resource that respond to the applied altered controls to the natural resource wells. The computing system may collect or obtain measurement data, e.g., by probing of resulting outcomes of the natural resource well production and by probing resulting changes in the natural resource subsurface reacted by the applied altered controls.

At 920, the computing system determines, based on the collected measurement data, the natural resource subsurface attributes and compositions. The determined natural resource subsurface attributes and compositions include, but are not limited to: permeability, porosity, seal factor, pressure, and saturation, of materials in the natural resource subsurface. Based on the measurement data and the determined natural resource subsurface attributes and compositions, the computing system further determines dynamics (i.e., changes, etc.) of the natural resource subsurface that responds to the applied altered controls.

FIG. 10 illustrates an example oil well recovery 1000. Injector wells 1085, for example, inject water or gas 1020 to the subsurface 1095 that contains an oil well 1050. The injected water or gas 1020 displaces oil or gas towards a production well 1090. Then, the production well 1090 produces oil and/or gas and/or water 1030 from the subsurface 1095.

In one embodiment, in order to determine the natural resource subsurface attributes and compositions, the computing system may apply a set of diverse configurations of altered controls to a corresponding natural resource subsurface.

FIGS. 4-7 illustrate the set of diverse configurations of the altered controls. FIG. 4 illustrates a first example configuration of a control applied to the natural resource well: every injector well (i.e., a facility that injects water or gas to a natural resource well) supplies equal rate of water (e.g., 4000 barrels of water per day 420) at the same rate 430 as time 410 elapses.

Figure 5:
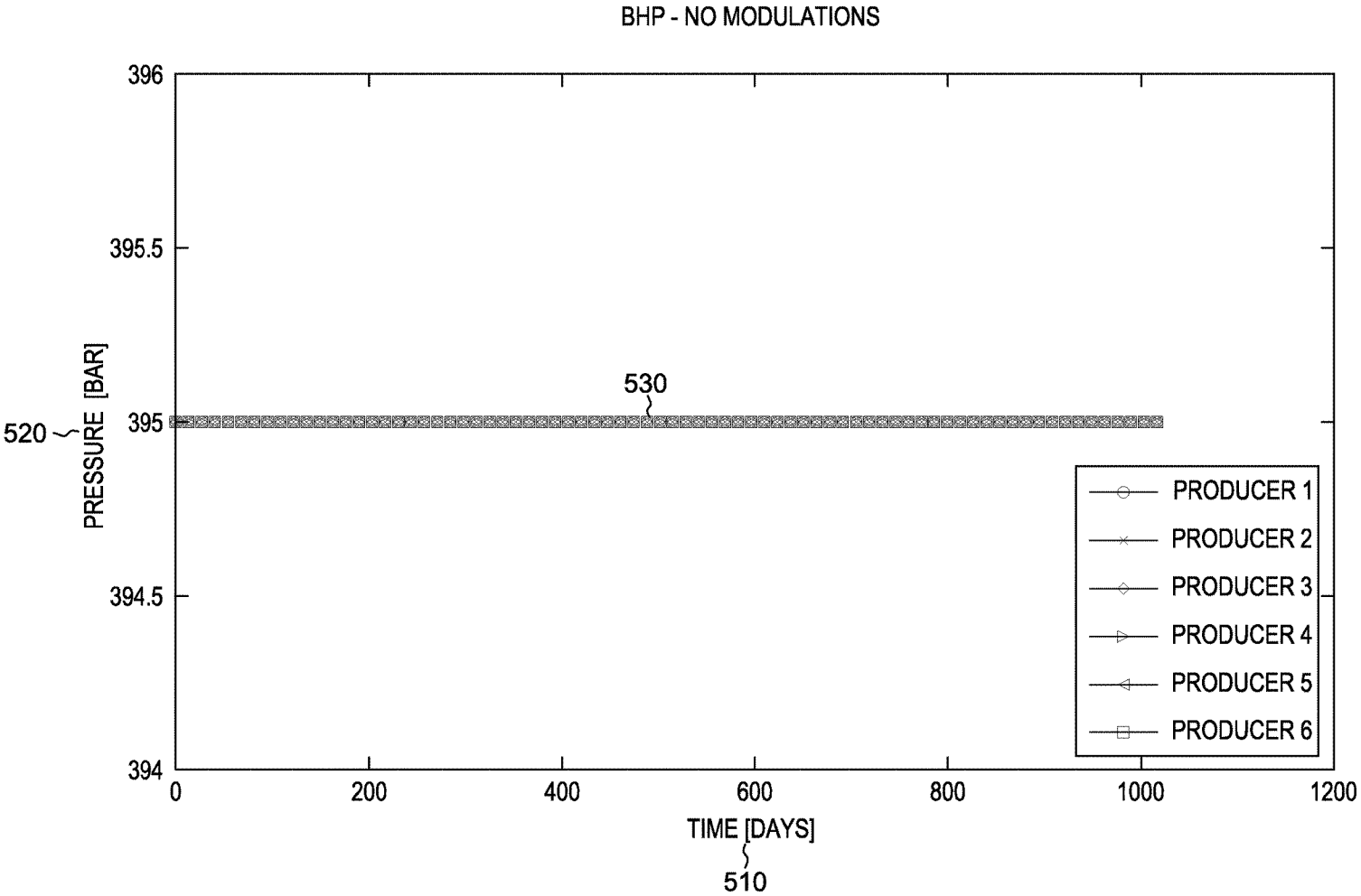
FIG. 5 illustrates an exemplary steady bottom-hole-pressure configuration of production wells in one embodiment.
Figure 6:
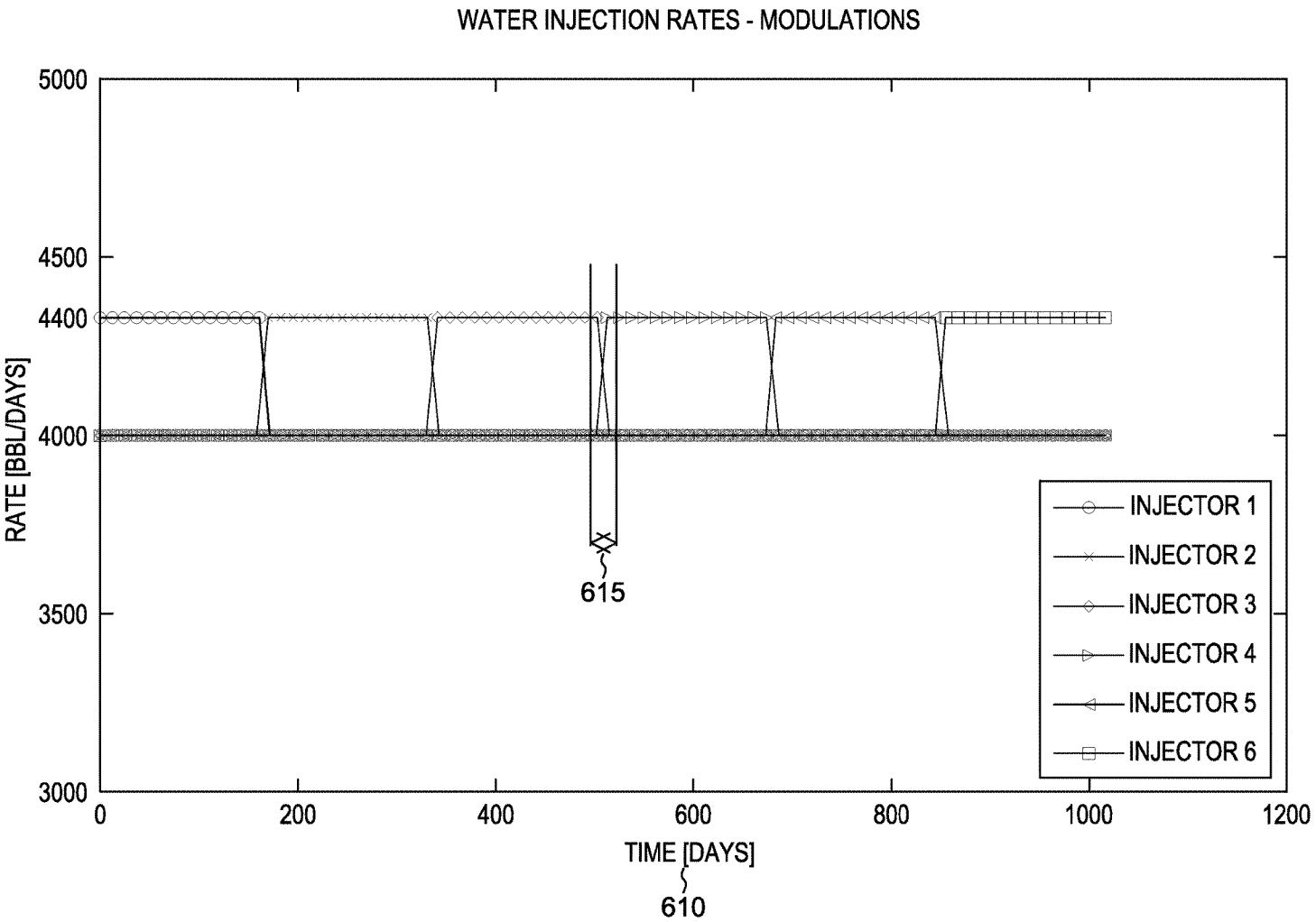
FIG. 6 illustrates varying rates of water injected to natural resource wells in one embodiment.

FIG. 5 illustrates a second example configuration of a control applied to the natural resource wells: every producer (i.e., a facility that recovers natural resource from a natural resource well) maintains a steady bottom-hole-pressure (BHP) 530 (e.g., 395 bar (520)) as times 510 pass. Bar in FIG. 5 refers to a unit of pressure measurement, e.g., one bar is equal to ten Newtons (N) per square centimeter ($cm^2$).

FIG. 6 illustrates a third example configuration of a control applied to the natural resource well: selected water injector(s) modulate 615 (i.e., vary) water injector rate, e.g., by a small amount (e.g., 400 barrels of water per day) each time for a time period, e.g., 5 days, as time 610 elapses.

Figure 7:
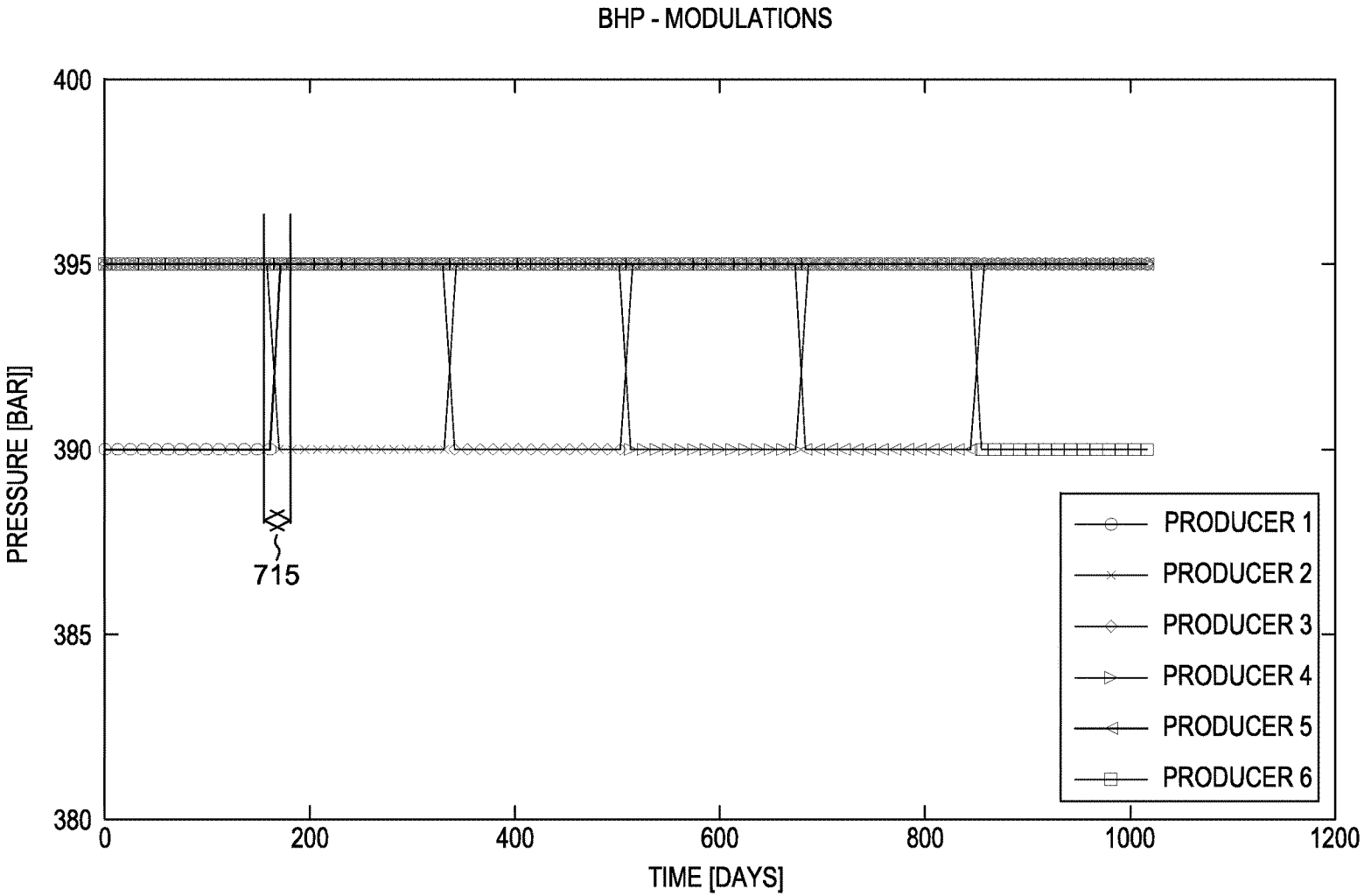
FIG. 7 illustrates varying bottom-hole-pressures incurred by varying of water injection in one embodiment.

FIG. 7 illustrates a fourth example configuration of a control applied to the natural resource well in which selected producers modulate 715 (i.e., vary) bottom hole pressures (e.g., 1 bar per day, etc.) of one or more natural resource well producers for a time period (e.g., 5 days, etc.) in turn and other natural resource producers maintain another bottom hole pressure (e.g., 395 bar, etc.) during that time period. In FIGS. 6-7, the alteration of controls (e.g., varying of water injection rate or varying of bottom hole pressures) occurs during short periods of time, e.g., 5 days as shown 615 in FIG. 6 and as shown in 715 in FIG. 7.

In one embodiment, the control modulations process (e.g., varying of water injection rate, etc.) applied to the subsurface, e.g., a subsurface 1095 shown in FIG. 10, etc., provides enhanced sensitivity information that maps responses of measurable (e.g., compositions of natural resource well, etc.) to one or more of the diverse configurations of the altered controls, e.g., by performing sensitivity analysis over the mapping associated with the responses of the measurable. The sensitivity analysis is described below.

In one embodiment, the computing system relies upon altered controls data collection paradigm that resembles data acquisition principle of various medical imaging techniques (e.g. Electrical Impedance Tomography, Computerized Tomography, Magnetic Resonance Imaging, etc.). According to medical imaging data acquisition principle, in order to probe the properties of a biological tissue or body part, energy (e.g. electro-magnetic field, radiation, etc.) is applied, (e.g. 105, 200) in a sequence of configurations while a sequence of measurements (e.g. 110, 115, 125, 135, 140, 145) of the response of the biological tissue or body part to the applied energy is being recorded. Based on this medical imaging technique principle, as a variety of different configurations of controls are applied to the natural resource subsurface, a variety of measurement data associated with the natural resource subsurface, e.g., through the sensors associated with the natural resource subsurface, are obtained. The responses of the natural resource subsurface may include, but are not limited to: a change occurring in the natural resource subsurface, an increase or decrease of natural resource recovery according to the varying water injection rate, change(s) in chemical compositions or constitutes in the subsurface etc. The derived responses to the control alternation offer comprehensive sensitivity information that can provide a user with an insight into the corresponding natural resource subsurface.

Based on the determined natural resource subsurface attributes and the compositions, the computing system optimizes the natural resource production process. The optimization of the natural resource production includes, but is not limited to: (1) maximizing net present value pertaining to the natural resource; (2) minimizing water production pertaining to the natural resource; and/or (3) determining a set of controls to be applied to the natural resource, etc.

In one embodiment, the computing system minimizes the applied altered controls, e.g., varying of water injection rates or varying of bottom hole pressure as shown in FIGS. 6-7, in order to satisfy an immediate natural resource production goal. For example, the difference between two different water injection rates of two different water injectors may be less than a threshold, e.g., 500 barrels per day. A time period during which the altered controls are applied may be less than a particular time period, e.g., 10 days.

In one embodiment, the computing system creates, based on the collected measurement data, a model pertaining to the natural resource subsurface. In one embodiment, the subsurface model includes, but is not limited to: (i) a natural resource prediction model that compute future natural resource production estimates for a given subsurface and set of (altered) controls; and (ii) a methodology of applying an altered control to the natural resource wells, etc. An example of such model includes, but is not limited to:

$$\max_{c} \sum_{t=t_0}^{T} \left\{ \sum_{i}^{N} f_i(c, m; t) - \sum_{i}^{N} g_i(c, m; t) \right\} \tag{1}$$

s.t.

$$l_j \le c_j \le u_j$$

$$G_k(c_k, m) \le 0$$

An objective of equation (1) may be maximizing profit or net present value. In equation (1), variable c stands for controllable(s) (e.g., water injection rate, bottom hole pressure), m stands for model parameters (e.g. permeability, porosity, seal factor), t stands for time instances, $t_o$ stands for an initial value of t, and T stands for an maximum value of t. i represents an index (or identification) number of each natural resource well. N represents the number of total natural resource wells. $f_i$ represents the amount or value of natural resource produced at each natural resource well, $g_i$ stands for the cost of operating each natural resource well (water injected, pumping operation costs, processing, etc). $c_j$ is the $j^{th}$ control entry of the controllable(s) c, $l_j$ and $u_j$ corresponds respectively to lower and upper bound values of the $j^{th}$ control entry. $G_k(c_k, m)$ corresponds to constraints or limitations applicable to the equation (1), for example, multiphase flow in porous medium, physical constraints, limitations of infrastructure associated with the natural resource infrastructure (e.g., pipe flow, tanks' capacity, gas-oil separators capabilities), etc. Constraints of the equation (1) guarantee that physical limitations ($G_k(c_k, m)$) of a corresponding oil well production system is honored. Other constraints of the equation (1) include, but are not limited to: (i) operation bounds for the controllable c; and (ii) physical constraints or limitations associated with the natural resource production, etc. The computing system may evaluate whether the responses (e.g., changes in the natural resource subsurface attributes and compositions in response to the altered controls applied to the natural resource subsurface, etc.) satisfy one or more of the constraints. If the responses do not satisfy the constraint(s), the computing system may adjust the controls applied to the natural resource well. In this way, the adjusted controls of the natural resource satisfy the one or more constraints.

Sensitivities of the subsurface model describe the relation(s) between the subsurface model, the collected measurement data, the parameters of the subsurface model and/or the controllable(s) of the subsurface model. In one embodiment, the computing system utilizes the sensitivities of the subsurface model for inference of the subsurface attributes, e.g., through a process called history matching. The history matching maps historic measurement data to the subsurface model, e.g., by means of non-linear inversion, non-linear dynamic filtration, a mapping technique, etc. The historic measurement data includes, but is not limited to: historic natural resource production rate, historic water injection rates, historic bottom hole pressures, etc. By applying the alteration of the controls throughout the production process, an enhanced sensitivity map is obtained. For example, a large number, e.g., more than 1,000, etc., of eigenvalues of the sensitivity map may exceed a predefined threshold compared to situation when no deliberate control alterations are practiced. Consequently, a greater number of effective independent measurements are obtained. The computing system may update the subsurface model according to the enhanced sensitivities relations and thereby improves resolution and fidelity of the inferred or characterized subsurface model.

In embodiment, the computing system ranks each of the diverse configurations of altered controls according to effectiveness in determining the natural resource subsurface attributes and compositions. For example, variation of water injection rate in a given well may provide greater information gain regarding the natural resource subsurface attributes and compositions than variation of bottom hole pressure of that given well. By applying principles resembling medical imaging data acquisition techniques to obtain multiple measurement data and by further applying a variety of the altered controls to the natural resource well, the computing system may determine an optimal strategy to modulate the controls (e.g., oil well bottom hole pressures, fluid flow rates, etc.) in order to enhance sensitivities of the created or the updated model. An exemplary optimal strategy may include: varying of water injection rate as shown in FIG. 6, varying of bottom hole pressure as shown in FIG. 7, etc.

By using known control theory, e.g., a feedback control system, open loop control system, etc., the user analyzes, identifies and/or controls a dynamical control system or circuit (not shown). A dynamic control system or circuit applied for this purpose includes, but is not limited to: a system or circuit that includes a feedback control system, a control circuit that represents a linear equation that has a feedback control loop or that does not include a feedback control loop, and a control circuit that represents a non-linear equation and that includes a memory device and/or a feedback control loop and/or no feedback control loop. The user can recover the natural resource from natural resource reservoir, e.g., by creating (or modeling) and using the dynamical control system (or circuit) which represents a linear equation or a non-linear equation (e.g., the equation (1)) in which values of parameters or components may either change variably over times or be fixed permanently. An example of this dynamic control system includes, but is not limited to: the equation (1), etc.

An objective of solving the equation (1) above may be an optimal control in natural resource reservoir management. A goal of the optimal control of the natural resource reservoir is to define a set of controls (e.g., bottom hole pressures, water injection rates, etc.) in order to maximize or increase or decrease or control a natural resource well production. In one embodiment, the computing system determines the equation (1) or similar formula based on reactions of the natural resource subsurface which respond to one or more varying control excitations (i.e., one or more of the altered controls). The one or more varying control excitations to the natural resource wells include, but is not limited to: varying of water injection rate to the natural resource wells, varying of bottom hole pressure of the natural resource wells, etc. Based on those reactions, the computing system may characterize the natural resource reservoir content, e.g., oil, natural gas, frozen gas, etc., through inference processes, for example, the history matching. In one embodiment, the determined and/or predicted reaction of the natural resource surface is recorded in, e.g., a storage device or a database, etc. By applying the altered controls to the natural resource wells, the computing system can obtain a better insight into the behavior of the natural resource reservoir (e.g., a natural resource reservoir 1050 shown in FIG. 10) or the natural resource well subsurface (e.g., a natural resource subsurface 1095 shown in FIG. 10), e.g., based on the reactions of the natural resource well subsurface that respond to the altered controls.

One or more of the medical imaging techniques can improve an ability of the user to characterize the properties of the natural resource well, e.g., by applying different altered controls to the natural resource well and gathering independent measurement data of the natural resource subsurface that react to the different altered controls.

The computing system alters the controls, e.g., through variation of water injection rate, etc., to the natural resource in order to improve the fidelity of a computation of the subsurface model. In one embodiment, least intrusive excitation(s), e.g., the variation of the bottom hole pressure of a corresponding production well, are selected to minimize impact upon production output. The chosen intrusive excitation must be distinguishable from noise (i.e., tiny variation of water injection rates, e.g., less than 400 BBL/days) but otherwise making the excitation small enough so that its impact upon the natural resource production is negligible (i.e., can be ignored).

Figure 1:
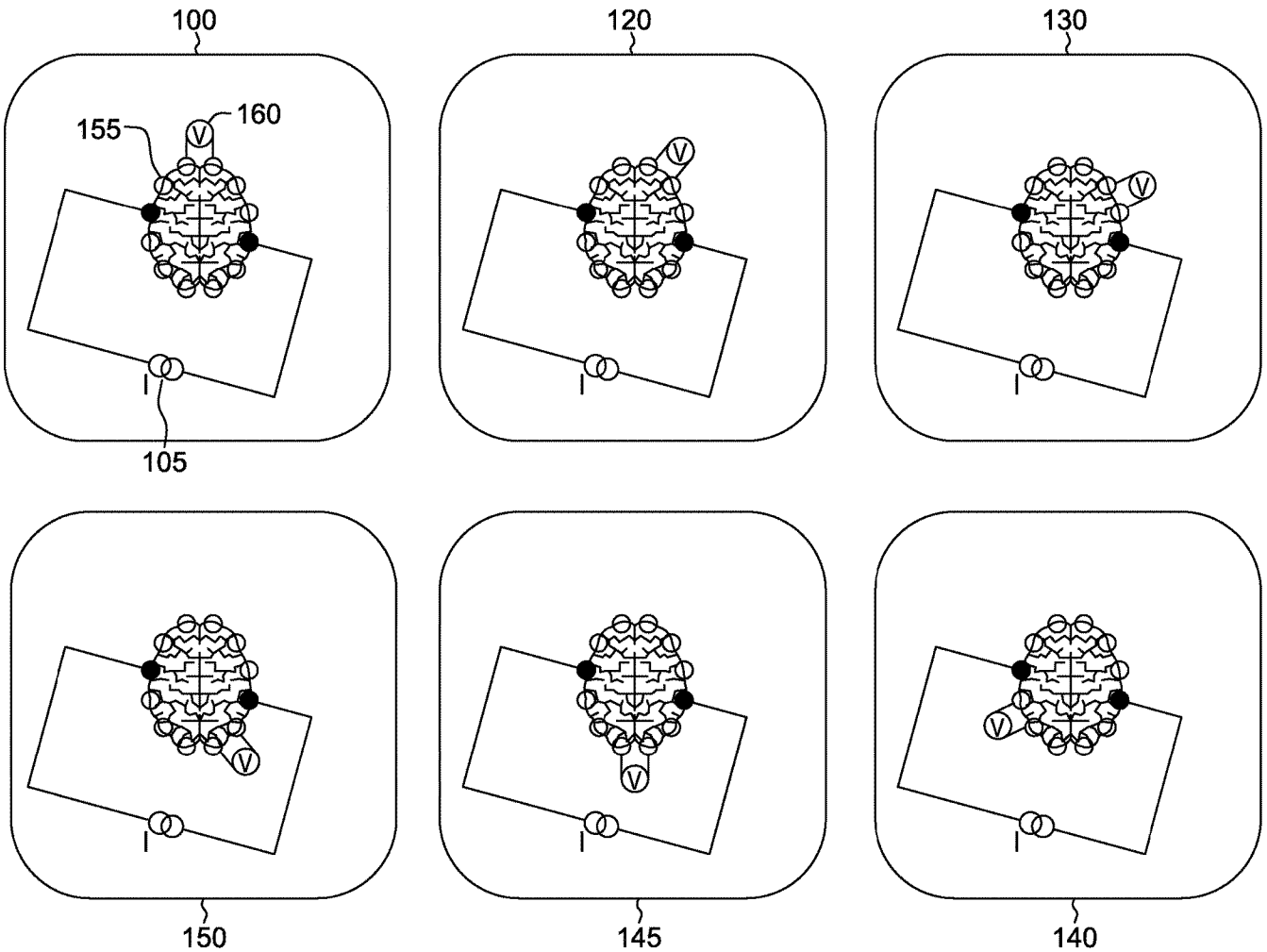
FIG. 1 illustrates a sequence of images pertaining to electrical impedance tomography (a medical imaging technique) data acquisition paradigm in one embodiment.

By using data acquisition principles that resembles those used in the medical imaging technique(s), the computing system may modulate (i.e., alter) controls (e.g., well pressures, rates, etc.) in order to enhance the sensitivities of the model, i.e., the association of the model and the measurement data pertaining to the natural resource subsurface. For example, FIG. 1 illustrates a sequence of medical images 100, 120, 130, 140, 145 and 150 that represents steps of a medical imaging technique, e.g., electrical impedance tomography, X-ray, Ultrasound, etc. In the medical imaging technique, different measurements are made responsive to a stimulus in order to obtain non-redundant measurement data. For example, in FIG. 1, the medical imaging technique is inferred using data that is collected sequentially. A stimulus source 105 is connected to a body part, e.g., a human head 155, in which the computing system measures a voltage potential 160 between two points of the body party for each of different configurations 100, 120, 130, 140, 145 and 150. For example, the different configurations may include applying different stimuli and taking measurements at different locations.

Figure 2:
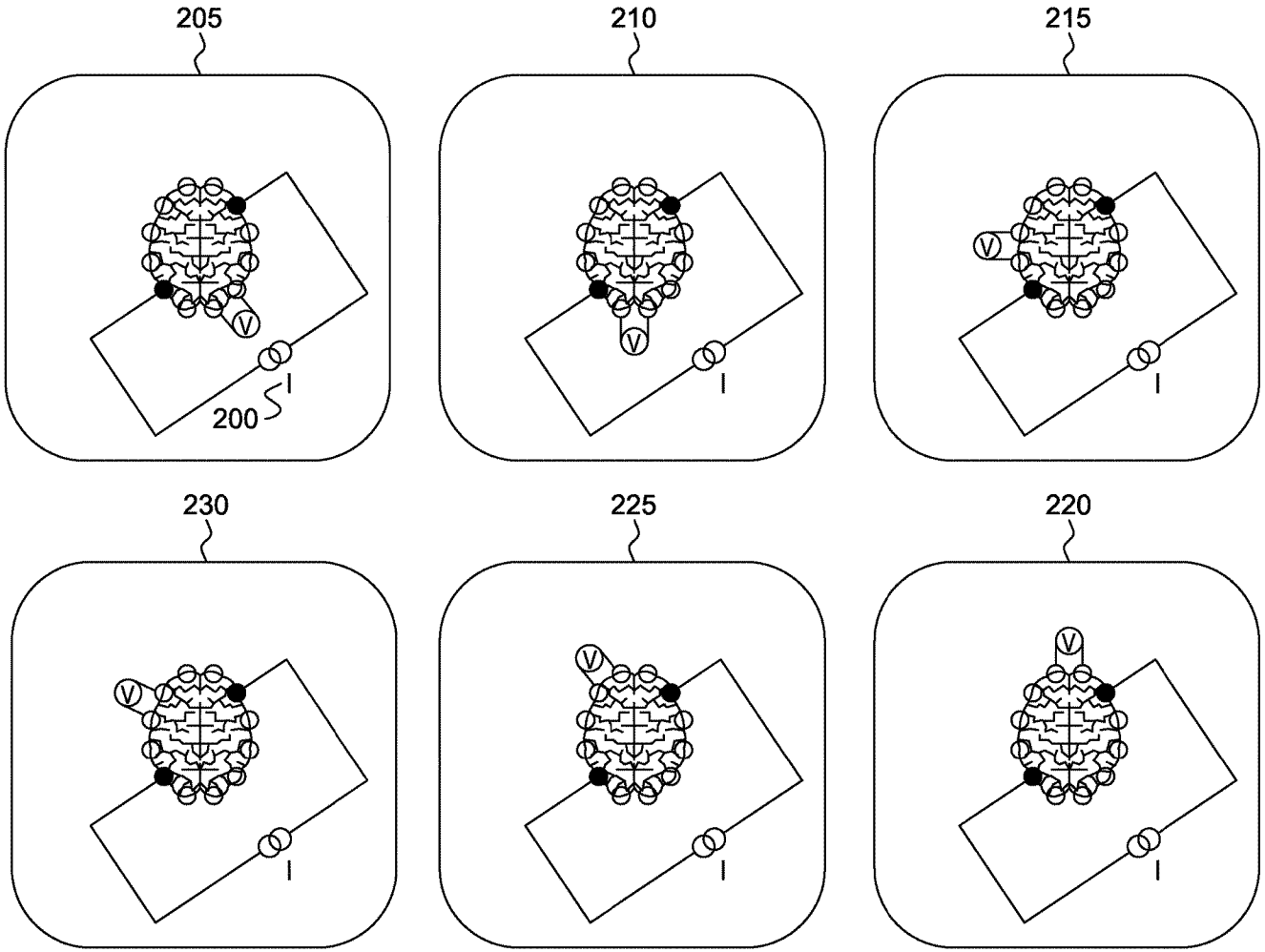
FIG. 2 illustrates a sequence of images pertaining to electrical impedance tomography (a medical imaging technique) data acquisition paradigm in another embodiment.

FIG. 2 illustrates another sequence of medical imaging data collection sequel. The location of the excitation has changed in FIG. 2 (i.e., stimulus source location changes from 105 to 200). In each successive measurement 205-230, the stimulus location is applied and corresponding measurements are obtained, at changed paired locations. For proper selection of the excitation pattern and measurement sequence, e.g., excitation patterns and measurements shown in FIGS. 1-2, data representing the interaction between the body party and the stimulus source at different locations provides non-redundant information.

In one embodiment, the principle of these medical imaging techniques pertains to excitation of a natural resource well and collecting measurement data from the natural resource wells. For example, for a natural resource subsurface reservoir(s), by using the principle of the medical imaging technique as described with reference to FIGS. 1-2 and by applying a control excitation to the natural resource wells, an enhanced sensitivity map can be computed. The enhanced sensitivity map illustrates responses of the natural resource reservoir to the control excitation(s). The control excitation(s) includes, but is not limited to: natural resource subsurface reaction to varying of water injection rate of the natural resource wells; and natural resource subsurface reaction to varying of bottom hole pressure of the natural resource well, etc. Sensitivity maps include, but are not limited to: observability Gramian (i.e., Gramian matrix used to determine whether a system is observable), controllability Gramian (i.e., Gramian matrix used to determine whether a system is controllable), mapping between a change in the subsurface model entries and the response of the subsurface to the altered controls (or changes in the measurement data due to applying different altered controls that reflect the change(s) in the subsurface model), etc. These sensitivity maps provide means to assess identifiability (feature and/or state distinctions) and controls of the natural resource production process, e.g., based on reactions of the natural resource subsurface to the altered controls.

In one embodiment, control excitations for enhancing the sensitivity maps may be negligible, e.g., a water injection rate varies only for few (e.g., five, etc.) days per a water injector. The effect of the excitation may also be negligible, i.e., may not affect a measurement noise (i.e., an error caused by the control excitation). A control excitation (i.e., an altered control) includes, but is not limited to: varying water injection rate, varying bottom hole pressure, etc. In one embodiment, in response to varying of water injection rate into a natural resource well, a bottom-hole-pressure of a natural resource well may also varies. In one embodiment, the impact of the control excitation upon the natural resource production may be negligible, for example, a control excitation may provide water to the natural resource well at the varying rate during a short time period, e.g., 5 days. The implementation of a control excitation (e.g., providing varying amount of water to the natural resource wells during a particular time period, etc.) is cost-effective due to the benefit given by the natural resource well identifiability. For subsurface characterization purposes, the computing system may concurrently or sequentially run multiple simulations pertaining to the natural resource production, for example, each simulation may have a different varying water injection rate and/or bottom hole pressure. Each simulation time (and the total simulation time of all the simulations) may be less than a pre-determined time period. For example, applying the altered controls to twelve natural resource wells for five days per each resource well results in, for example, sixty days of the total simulation time.

By modulating the controls, e.g., varying the water injection rate to the natural resource well or varying of bottom hole pressure of the natural resource well, the computing system can characterize the natural resource reservoir dynamics, e.g., by using one or more sensor(s) associated with the natural resource subsurface. Sensors include, but are not limited to: device(s) for measuring of permeability, device(s) for determining chemical compositions, device(s) for measuring an electric power, a mechanical power, image sensor(s), an electric voltage or an electric current, etc. The control modulation(s) leads to the enhanced sensitivity map that can be used to better characterize a natural resource, e.g., through the history matching and sensitivity analysis (i.e., data analysis over the associations between the subsurface model, the collected measurement data, the parameters of the subsurface model and/or controllables of the subsurface model).

A sensitivity analysis may then be used to directly reduce the number of subsurface parameters, and thereby enable faster computation of the subsurface model, e.g., equation (1) above. Enhanced sensitivities reduce uncertainty, e.g., by reducing the number of parameters and consequently improve the sensitivities of the model, e.g., improved mapping between the subsurface model and the measurement data. For example, in equation (1), the computing system may derive the cost of operating a given resource well, $g_t$, to be a set value, e.g., 1 million US dollars per year, based upon a low fidelity estimate (through history matching with sensitivities information based on no control alternations) of the subsurface model m. Conversely, history matching based on the enhanced sensitivities may offer higher fidelity estimate of the subsurface model parameters, and thereby more reliable and realistic estimates of the associated operational costs. Sensitivity analysis includes, but is not limited to: (1) analyzing the sensitivity maps, (2) evaluating, transforming and modeling of the measurement data, the data obtained from the subsurface model, and/or the arguments and the parameters of the subsurface model.

Modulation of the controls provides data that represents the response of the subsurface to varying physical conditions (e.g., varying water injection rates, etc.) associated with the natural resource well production. By using one or more known data analysis technique(s), the computing system creates, based on the provided data, a sensitivity map(s) which provide useful data entries (e.g., above measurement noise level). For example, the sensitivity map associates corresponding changes in the measurement data with a change(s) in the model parameters or control input (e.g., the controllable in the subsurface model, etc.). For example, the sensitivity map associates a change in an oil production rate in a given well with respect to a change in a permeability of a corresponding natural resource subsurface. As more information is used for construction of these sensitivity relations, their uses are of a higher level of fidelity.

The modulated control to the natural resource well may provide an insight (identifiability) into reservoir subsurface content: for example, by varying the water injection rate to the natural resource well, the computing system determines natural resource subsurface attributes and compositions by monitoring reactions of the subsurface to the varying water injection rate through the sensors embedded in the subsurface. The modulated control of the natural resource well improves a capability for adjusting of controls of the natural resource wells, e.g., by determining the best water injection rate among diverse water injection rates which produces the maximum amount of natural resource during a particular time period. Thereby, the computing system may optimize an overall natural resource production rate from a corresponding natural resource well, e.g., by injection of water or gas into a natural resource at the best (or optimal) water injection rate. The computing system may improve the insight of the user to the natural resource well, e.g., by applying altered controls to the natural resource subsurface.

By running method steps in FIG. 9, the computing system implements a geo-statistical dynamic characterization technique (i.e., statistical characterization of spatial data that dynamically changes; e.g., correlogram—an image that represents correlation of data, etc.) that utilizes the modulated controls to the natural resource in order to offer a comprehensive characterization of the dynamics of the natural resource subsurface within a negligible simulation time.

The computing system may also determine a limitation of a natural resource facility component (e.g., separators, gas handling, pipelines, etc.). For example, in order to increase natural resource production based on the determined natural resource subsurface attributes and compositions, the current capacity of natural resource pipeline may not be enough to deliver the increased production of natural resource from the natural resource wells to a natural resource refinery. The computing system may determine a location and/or outcome of placing a natural resource producer (i.e., a facility that recovers natural resource from a natural resource) at a particular location with respect to all possible future production scenarios (i.e. every possible control configuration—closeness to source of water to be injected to natural resource well, closeness to a natural resource well refinery, regulation of a city or county or country regarding natural resource well production at the particular location, natural resource subsurface attributes and compositions that surround the natural resource well, safety and environment regulations ($CO_2$ regulation) in building the natural resource well production facility at the particular location, etc., $CO_2$ sequestration—understanding the potential flow passages of $CO_2$.

The user or the computing system applies each modulation (e.g., modulation of water injection rate) of control for short periods of time, e.g., 5 days (615 shown in FIG. 6), etc., to avoid a significant influence upon the natural resource production. In addition, modulations may be relatively small in magnitude, for example, the difference between an original water injection rate and a modulated water injection rate may be within 400 barrels of water per day. Minimizing the difference may serve two purposes:

1. Adverse influence (e.g., sudden occurrence of a blowout of a natural resource well) upon production is minimized.
2. Modulation of the controls in each natural resource well and its observables (e.g., the measurement data) satisfy the constraints (e.g., the maximum total amount of water to be injected to a natural resource shall not increase by more than 400 barrels of the baseline). If the modulation violates the constraints, a reactive measure (e.g., shutting down a natural resource well completely) may result. Applying small modulations (e.g., the amount of water injection to be increased may be less than 400 barrels, modulated bottom hole pressure of the natural resource well may be within 5 bar, etc.) may prevent a cascade of natural resource well constraint violations and consequent reactions, e.g., an oil spill from the natural resource well production.

The sensitivity of the model parameters to the measurement data (i.e., a relationship between the model parameter and the measurement data) is a factor in determining (i.e., characterizing, etc.) the natural resource subsurface attributes and compositions and dynamics. The sensitivity of the model allows the user to identify how a change in a model parameter influences the measurement data. The more comprehensive the sensitivity of the subsurface model, the computing system and/or the subsurface model has the better ability to determine the model parameters based on the measurement data. In order to derive the sensitivity of the model, the computing system may probe the medium (i.e., natural resource subsurface), e.g., through applying of the altered controls (e.g., varying of water injection rates, etc.), while reading the resulting responses to the altered controls, e.g., sensors associated from the medium.

In the course of operation or simulation of the natural resource well production, inputs to the operation or the simulation of the natural resource well production are the (altered) controls, e.g., varying amount of water injected to the natural resource well, etc. Rather than maintaining the model parameter(s) values fixed (e.g., controls applied to the natural resource well are fixed), the computing system applies a diverse set of control excitations (i.e., the altered controls) and obtains measurements characterizing reactions at different locations of the natural resource well for each stimulus or control excitation as in the medical imaging technique. In one embodiment, the computing system modulates (i.e., alters) the controls: while maintaining most of all controls fixed (i.e., most of the model parameters fixed), one or several controls (i.e., one or more of the model parameters) are changing at a time.

Once the modulation of the controls, e.g., varying of water injection rates to a natural resource wells, is authorized by one or more authorized users, the modulation (e.g., varying the water injection rate or varying of bottom hole pressure of the natural resource well) is applied to the natural resource wells. In one embodiment, before applying the modulation, the natural resource producer wells may simulate the modulation and its effect of applying the modulation to the natural resource. In order to derive the sensitivity map, the computing system runs additional adjoint simulation(s) sequentially or concurrently. Adjoint simulation(s) include, but are not limited to: simulation with alternative set of injecting facilities, measurement sites, etc.

Figures 8A, 8B, 8C:
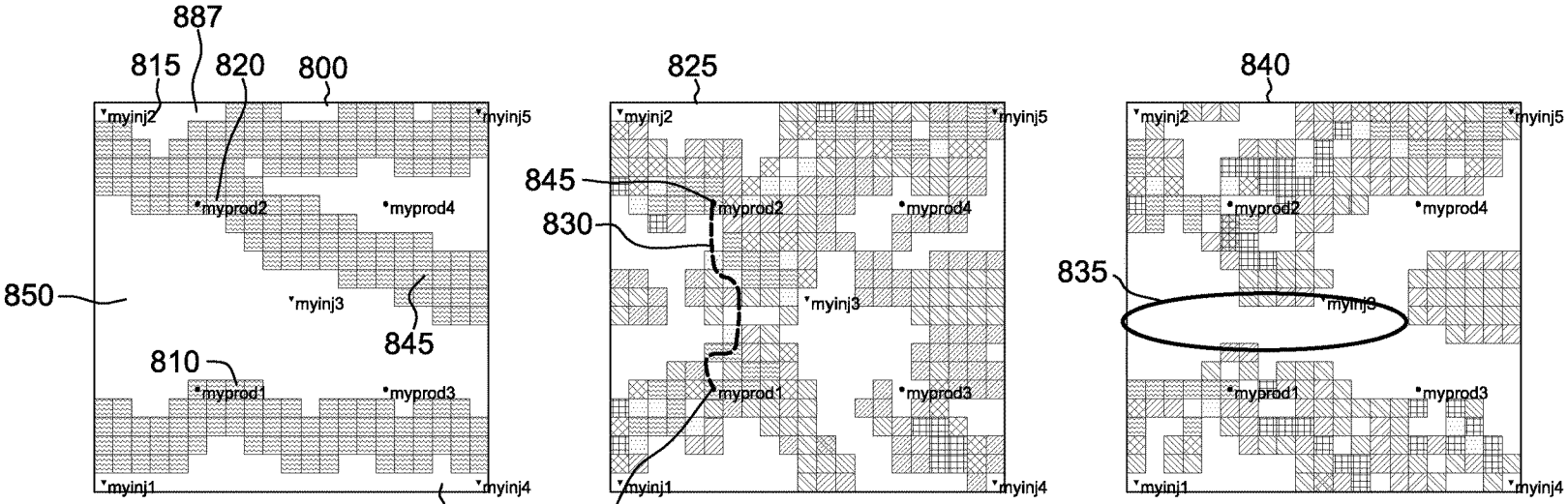
FIGS. 8A-8C illustrate examples of enhanced recovery.

FIGS. 8A-8C illustrate exemplary natural resource recoveries. FIG. 8A shows an exemplary image of practical settings in which natural resource distribution is unknown. In a true model 800 (i.e., original natural resource subsurface attributes and compositions, with natural resource producers (810, 820, etc.)), a zone 845 includes high permeability materials, e.g., mudrock, sandstone, etc. A zone 850 includes less permeable materials, e.g., basalt, granite, quartzite, etc. In the true model 800, a natural resource well producer 1 (810) recovers natural resource upon receiving water/other material injected from various injector wells, for example, injector 1 (805) located at a zone 885. A natural resource well producer 2 (820) recovers the material injected from a water/material injector 2 (815) located at zone 887. Depending upon the substructure properties, e.g. permeability, porosity, seal factor, etc., the forcing terms (determined by the modulated controls), e.g., subsurface fluids and gas, etc. are transported to the natural resource producers.

Recovery of the permeability without utilization of the control modulations is illustrated in FIG. 8B. Comparison of this recovery to the true model (FIG. 8A) shows discrepancies: for example, the two channels 845 and 810 erroneously appear connected 830. By applying method steps shown in FIG. 9, the computing system determines the natural resource subsurface attributes as shown in FIG. 8C. The recovery using the control modulation is with greater agreement with the true model (i.e., FIG. 8A). For instance, as shown in FIG. 8C, the region 835 between the two channels (845 and 810) was recovered as a high permeability region, which is consistent with the true model (i.e., FIG. 8A).

In order to determine natural resources subsurface attributes, inputs to the model (e.g., equation (1), etc.) include, but are not limited to: controllables c in the equation (1) which represent (historic measured) water injection rate, (historic measured) bottom hole pressure, an initial inference for a permeability map (e.g. at a uniform value of 1000 mDarcy), etc. In FIGS. 8B-8C, when comparing the two recovery methodologies (i.e., 825—incorrect determination of natural resource subsurface attributes and compositions due to not applying altered controls to the natural resource subsurface and 840—correct determination of natural resource subsurface attributes and compositions by applying altered controls to the natural resource subsurface), the comparison demonstrates that natural resource recovery based on 840 may determine more correctly the natural resources attributes. In 825 (i.e., FIG. 8B), it appears that there exists a high permeability link 830 between the natural resource well producer 2 and the natural resource well producer 1. The high permeability link 830 is a false link that did not exist in the true model 800 (i.e., FIG. 8A).

In one embodiment, the methods shown in FIG. 9 may be implemented as hardware on a reconfigurable hardware, e.g., FPGA (Field Programmable Gate Array) or CPLD (Complex Programmable Logic Device), by using a hardware description language (Verilog, VHDL, Handel-C, or System C). In another embodiment, the methods shown in FIGS. 9 and 10 may be implemented on a semiconductor chip, e.g., ASIC (Application-Specific Integrated Circuit), by using a semi custom design methodology, i.e., designing a semiconductor chip using standard cells and a hardware description language.

While the invention has been particularly shown and described with respect to illustrative and preformed embodiments thereof, it will be understood by those skilled in the art that the foregoing and other changes in form and details may be made therein without departing from the spirit and scope of the invention which should be limited only by the scope of the appended claims.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with a system, apparatus, or device running an instruction.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with a system, apparatus, or device running an instruction.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C, C++, .Net, or the like and conventional procedural programming languages, such as the "C" programming language or similar programming languages. The program code may run entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which run via the processor of the computer or other programmable data processing apparatus, create means for implementing the functions/acts specified in the flowchart and/or block diagram block or blocks. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which run on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more operable instructions for implementing the specified logical function(s). It should also be noted that, in some alternative implementations, the functions noted in the block may occur out of the order noted in the figures. For example, two blocks shown in succession may, in fact, be run substantially concurrently, or the blocks may sometimes be run in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A method for recovery of attributes and compositions of a natural resource subsurface, the method comprising:

defining one or more control parameters to be applied for a natural resource well including a natural resource, wherein the one or more control parameters comprise a water injection rate of injecting water into the natural resource well and a corresponding magnitude of the water injection rate is modulated periodically as a function of time;

applying the defined control parameters to the natural resource well;

collecting measurement data pertaining to the natural resource well, the measurement data being generated by the natural resource well as a result of the natural resource well reacting to the applied defined control parameters; and determining, based on the collected measurement data, the natural resource subsurface attributes and compositions that pertain to the natural resource, said determining comprising:

applying different configurations of the applied defined control parameters to a corresponding natural resource subsurface;

deriving responses of the corresponding natural resource subsurface to the applied different configurations to aid in determining the natural resource subsurface attributes and compositions; and repeating the applying the different configurations of the defined control parameters and the deriving the responses at each iteration, wherein a processor device coupled to the memory device is configured to perform the defining, the applying, the collecting and the determining.

2. The method according to claim 1, wherein the control parameters further comprise a bottom-hole-pressure of the natural resource well.

3. The method according to claim 1, wherein a difference between a maximum value and a minimum value of the water injection rate is equal to or smaller than ten percent of the minimum value.

4. The method according to claim 1, wherein the collecting includes:

detecting, based on the collected measurement data, reactions of a corresponding natural resource subsurface in response to the applied defined control parameters.

5. The method according to claim 1, further comprising:

creating, based on the collected measurement data, a subsurface model pertaining to natural resource well production from the natural resource well.

6. The method according to claim 5, further comprising:

detecting sensitivity of the subsurface model, the sensitivity representing an association among the natural resource subsurface attributes and composition and the collected measurement data.

7. The method according to claim 6, further comprising:

applying a history matching process to the subsurface model, the history matching process mapping historic measurement data to the subsurface model;

using the applied history matching process to update the subsurface model.

8. The method according to claim 5, wherein the subsurface model comprises one or more of:

a natural resource production prediction model that computes a future natural resource production; or a methodology of applying an altered control to the natural resource well.

9. The method according to claim 1, further comprising:

determining whether the derived responses satisfy one or more constraints.

10. The method according to claim 1, further comprising:

optimizing, based on the determined natural resource subsurface attributes and compositions, a natural resource production.

11. The method according to claim 10, wherein the optimizing:

maximizing net present value pertaining to the natural resource well production; or minimizing water production pertaining to the natural resource well production.

12. The method according to claim 10, wherein the optimizing comprises:

determining a set of control parameters to be applied to the natural resource well.

13. A system for discovering attributes and compositions of a natural resource subsurface, the system comprising:

a memory device;

a processor device coupled to the memory device, wherein the processor device is configured to perform:

defining one or more control parameters to be applied for a natural resource well including a natural resource, wherein the one or more control parameters comprise a water injection rate of injecting water into the natural resource well and a corresponding magnitude of the water injection rate is modulated periodically as a function of time;

applying the defined control parameters to the natural resource well;

collecting measurement data pertaining to the natural resource well, the measurement data being generated by the natural resource well as a result of the natural resource well reacting to the applied defined control parameters; and determining, based on the collected measurement data, the natural resource subsurface attributes and compositions that pertain to the natural resource well, wherein for the determining, the processor device is further configured for:

applying different configurations of the applied defined control parameters to a corresponding natural resource subsurface;

deriving responses of the corresponding natural resource subsurface to the applied different configurations; and repeating the applying the different configurations of the defined control parameters and the deriving the responses at each iteration.

14. The system according to claim 13, wherein the control parameters further comprise a bottom-hole-pressure of the natural resource well.

15. The system according to claim 13, wherein the processor device is further configured to perform:

creating, based on the collected measurement data, a subsurface model pertaining to natural resource production from the natural resource well.

16. The system according to claim 15, wherein the processor device is further configured to perform:

deriving sensitivity of the subsurface model, the sensitivity representing an association between the created subsurface model and the collected measurement data.

17. The system according to claim 16, wherein the processor device is further configured to perform:

applying a history matching process to the subsurface model, the history matching process mapping historic measurement data to the created subsurface model; and based on the derived sensitivity and the applied history matching process, updating the subsurface model.

18. The system according to claim 15, wherein the subsurface model comprises one or more of:

a natural resource production prediction model that computes a future natural resource production; or a methodology of applying altered control parameters to the natural resource well.

19. A control circuit for enhancing natural resource well production, the control circuit being configured to perform:

defining one or more control parameters to be applied for a natural resource well including a natural resource, wherein the one or more control parameters comprise a water injection rate of injecting water into the natural resource well and a corresponding magnitude of the water injection rate is modulated periodically as a function of time;

applying the defined control parameters to the natural resource well;

collecting measurement data pertaining to the natural resource well, the measurement data being generated by the natural resource well as a result of the natural resource well reacting to the applied defined control parameters;

determining, based on the collected measurement data, the natural resource subsurface attributes and compositions that pertain to the natural resource well, wherein for the determining, the control circuit is further configured for:

applying different configurations of the applied defined control parameters to a corresponding natural resource subsurface;

deriving responses of the corresponding natural resource subsurface to the applied different configurations;

repeating the applying the different configurations of the defined control parameters and the deriving the responses at each iteration; and optimizing, based on the determined natural resource subsurface attributes and compositions, the natural resource production.

20. The control circuit according to claim 19, wherein the control parameters further comprise a bottom-hole-pressure of the natural resource well.

21. A computer program product for enhancing natural resource subsurface characterization, the computer program product comprising a computer readable storage medium, the computer readable storage medium excluding a propagating signal, the computer readable storage medium readable by a processing circuit and storing instructions run by the processing circuit for performing a method, said method steps comprising:

defining one or more control parameters to be applied for a natural resource well including a natural resource, wherein the one or more control parameters comprise a water injection rate of injecting water into the natural resource well and a corresponding magnitude of the water injection rate is modulated periodically as a function of time;

applying the defined control parameters to the natural resource well;

collecting measurement data pertaining to the natural resource well, the measurement data being generated by the natural resource well as a result of the natural resource well reacting to the applied defined control parameters; and determining, based on the collected measurement data, the natural resource subsurface attributes and compositions that pertain to the natural resource well, said determining comprising:

applying different configurations of the applied defined control parameters to a corresponding natural resource subsurface;

deriving responses of the corresponding natural resource subsurface to the applied different configurations to aid in determining the natural resource subsurface attributes and compositions; and repeating the applying the different configurations of the defined control parameters and the deriving the responses at each iteration.

22. The computer program product according to claim 21, wherein the control parameters further comprise a bottom-hole-pressure of the natural resource well.

* * * * *